US011035204B2

(12) United States Patent
Hjertholm

(10) Patent No.: US 11,035,204 B2
(45) Date of Patent: Jun. 15, 2021

(54) WELLBORE HYDRAULIC LINE IN-SITU RECTIFICATION SYSTEM AND METHOD

(71) Applicant: WELLMEND AS, Lepsøy (NO)

(72) Inventor: Pål Hjertholm, Lepsøy (NO)

(73) Assignee: WELLMEND AS, Lepsøy (NO)

( * ) Notice: Subject to any disclaimer, the term of this patent is extended or adjusted under 35 U.S.C. 154(b) by 0 days.

(21) Appl. No.: 16/607,663

(22) PCT Filed: Apr. 23, 2018

(86) PCT No.: PCT/NO2018/050109

§ 371 (c)(1),
(2) Date: Oct. 23, 2019

(87) PCT Pub. No.: WO2018/199769

PCT Pub. Date: Nov. 1, 2018

(65) Prior Publication Data

US 2020/0095846 A1 Mar. 26, 2020

(30) Foreign Application Priority Data

Apr. 24, 2017 (NO) ..... 20170676

(51) Int. Cl.
*E21B 37/00* (2006.01)
*B08B 9/043* (2006.01)
(Continued)

(52) U.S. Cl.
CPC ..... *E21B 37/00* (2013.01); *B08B 9/0436* (2013.01); *E21B 17/20* (2013.01); *E21B 34/10* (2013.01); *E21B 41/00* (2013.01)

(58) Field of Classification Search
CPC ..... E21B 41/00; E21B 17/20; E21B 34/10; E21B 37/00; B08B 9/0436
See application file for complete search history.

(56) References Cited

U.S. PATENT DOCUMENTS 1,803,425 A * 5/1931 Cunningham ..... E03F 9/00 15/104.31
4,501,322 A 2/1985 Martin
(Continued)

FOREIGN PATENT DOCUMENTS

CN 108643858 A 10/2018
GB 2311546 A 10/1997
(Continued)

OTHER PUBLICATIONS

International Search Report issued in PCT/NO2018/050109 (PCT/ISA/210), dated Jul. 24, 2018.
(Continued)

*Primary Examiner* — Nicole Coy
(74) *Attorney, Agent, or Firm* — Birch, Stewart, Kolasch & Birch LLP

(57) ABSTRACT

A wellbore hydraulic line rectification device arranged to rectify a hydraulic line in-situ includes a rectification line feeder, and a longitudinal first rectification line. The rectification line feeder is arranged to feed the first rectification line longitudinally into the hydraulic line. A cross section of the first rectification line has at least three protrusions arranged to slide along an inner surface of the hydraulic line.

20 Claims, 5 Drawing Sheets

(51) Int. Cl.

| | |
|---|---|
| ***E21B 17/20*** | (2006.01) |
| ***E21B 41/00*** | (2006.01) |
| ***E21B 34/10*** | (2006.01) |

(56) References Cited

U.S. PATENT DOCUMENTS

| | | | | |
|---|---|---|---|---|
| 4,705,107 | A | 11/1987 | Council et al. | |
| 5,230,116 | A * | 7/1993 | Rodriguez | E03D 11/00 15/104.33 |
| 6,273,187 | B1 * | 8/2001 | Voisin, Jr. | E21B 23/04 166/297 |
| 8,640,769 | B2 * | 2/2014 | Smith | E21B 17/1035 166/242.2 |
| 9,393,601 | B2 * | 7/2016 | Ronck | B08B 9/0436 |
| 10,081,998 | B2 * | 9/2018 | Tunget | E21B 17/1078 |
| 2003/0094419 | A1 | 5/2003 | Vickio, Jr. | |
| 2009/0050333 | A1 | 2/2009 | Smith et al. | |
| 2009/0205831 | A1 * | 8/2009 | Jacob | E21B 34/105 166/311 |
| 2009/0205832 | A1 * | 8/2009 | Jean-Luc | E21B 17/025 166/312 |
| 2013/0216314 | A1 * | 8/2013 | Critsinelis | F16L 1/23 405/168.3 |
| 2015/0158059 | A1 | 6/2015 | Smith | |
| 2016/0089703 | A1 | 3/2016 | Del Piero | |

FOREIGN PATENT DOCUMENTS

| | | | |
|---|---|---|---|
| GB | 2 320 076 | A | 6/1998 |
| WO | WO 2004/076797 | A2 | 9/2004 |
| WO | WO 2006/133350 | A2 | 12/2006 |

OTHER PUBLICATIONS

Written Opinion of the International Searching Authority issued in PCT/NO2018/050109 (PCT/ISA/237), dated Jul. 24, 2018.

* cited by examiner

WELLBORE HYDRAULIC LINE IN-SITU RECTIFICATION SYSTEM AND METHOD

TECHNICAL FIELD

The present invention relates to systems and methods for rectification of wellbore hydraulic lines in-situ, typically running along the production tubing from the wellhead to a sub-surface location. Such hydraulic lines can be e.g. control lines connected to Surface controlled sub-surface safety valves (SCSSVs), such as Down Hole Safety Valves (DHSV) or Annulus Safety Valves (ASV), where connection has been lost due to a blocked or leaking control line and rectification is required for further operation of the wellbore.

BACKGROUND

For safety reasons, wellbores are equipped with downhole safety valves (DHSV) that will isolate the part of the wellbore below the safety valve in the event of a failure or emergency. The DHSVs should operate failsafe, i.e. that the safety valve closes automatically if a failure, such as excessive pressure or drop of flow occur in the wellbore. This is typically achieved by maintaining the valve open by applying a hydraulic pressure. As soon as the pressure is lost, the valve will automatically close, and production will stop.

DHSVs operated from surface through a control line are often termed Surface controlled sub-surface safety valves (SCSSVs). In this case the control line run along the production tubing down to the safety valve.

The SCSSV is maintained in an open position by applying a hydraulic pressure from surface, all the way down to the safety valve through the control line. The safety valve may have a spring loaded flap that closes the tubing as soon as there is no hydraulic pressure to counteract the spring force.

FIG. 1 illustrates a typical prior art wellbore with an SCSSV (40) arranged in the production tubing (61). A wellhead (62) and casing strings supported by tubing and casing hangers (63, 64, 65) set in the wellhead (62) are also illustrated. The wellhead is usually installed on top of the first casing string as illustrated, but other configurations are possible. Typically, a well contains multiple intervals of casing successively placed within the previous casing run, e.g., conductor casing, surface casing, intermediate casing, production casing, and production liner. The wellhead (62) is topped with the Christmas tree (not shown).

The figure is for illustration only, and the relative dimensions are not indicative of a real wellbore. Further, the lower part of the well bore has been left out.

On the surface, a safety valve control system (67) with a control panel is hydraulically connected to the surface controlled sub-surface safety valve (40) via the control line (50). Typically the control line (50) runs along the production tubing up to the wellhead (62), through the tubing hanger (63), through the wall of the wellhead (62), where it is terminated in a hydraulic block (66). After or during completion, the safety valve control system (67) is connected to the hydraulic block (66) to allow hydraulic connectivity between the safety valve control system (67) and the SCSSV (40).

Such valves are required in wellbores in most countries. In general, the safety valves are either wireline retrievable or tubing retrievable. An example of such a valve is given in FIG. 2*a*, where the valve is in closed position, and in FIG. 2*b*, where it is in open position. In the safety valve (40) shown, a sliding sleeve (45) is pushed upwards by a spring (42). A fluid flowing upwards will force the flap (41) to close the tubing. Thus, the fluid is not allowed to flow upwards. The valve (40) can be opened by applying a hydraulic pressure in the fluid chamber (44) that overcomes the spring force from the spring (42). To achieve this, hydraulic fluid is pumped down the control line (44), running along the tubing, into the fluid chamber (44). When the pressure is sufficiently large, the sliding sleeve (45) will be forced downwards, and open the flap (41), as shown in FIG. 2*b*. As will be understood from the above, a loss or reduction of hydraulic pressure in the fluid chamber (44), will cause the valve to close.

The above is only one example of a surface controlled sub-surface safety valve. Other implementations exist, such as ball or poppet types.

One objective of the invention disclosed herein is related to preventing unintentional closing of the valve due to a failure in the valve control system.

As previously mentioned, the control line typically runs along the production tubing from a control system with a control panel at a surface location down to the safety valve. Such a control line can run hundreds of meters below the seabed and typically have an inner diameter of only 4 mm.

The control lines are usually wound around the tubing to allow slack, and bent close to the terminations for fastening purposes.

The problem with lost communication to Surface controlled sub-surface safety valves (SCSSVs), such as Down Hole Safety Valves (DHSV) or Annulus Safety Valves (ASV) is in many occasions caused by clogging of the control line as a result of build-up of debris or particles.

It is well known that such control lines are subject to contamination or blocking due to debris, contamination, or particles that develop and become suspended in the control fluid. The problem can originate from reservoirs, physical wear of system components, chemical degradation, and other sources. Problems may also be related to maintenance or testing of the control line involving bleeding off pressure, which allows hydrocarbons and particles to enter the control line. This could be the case when bleeding off pressure on the control line to test its barrier integrity, or when pumping additional hydraulic fluid into the control line due to a leak.

Chemicals are in some cases used to fix leaking control lines, but this may itself cause plugging of the control line above the leakage point.

Independent of the source of the problems, blocking or leakage, or a combination of the two will inhibit fluid communication between the surface pressure source and the safety valve since it is not possible to maintain a sufficient pressure at the safety valve, and communication will in any case be limited or lost, and the safety valve will close.

U.S. Pat. No. 4,705,107 A discloses a system for cleaning wells with coil tubing, a fluid motor and cutter heads. The invention allows equipment used to clean boiler tubes or heat exchangers to remove downhole deposits from the inside diameter of well tubulars US2003094419 A1 proposes a general method for cleaning and pressure testing hydraulic control systems. The method is carried out by establishing a turbulent flow of cleaning fluid through the hydraulic control system and maintaining the turbulent flow until the hydraulic control system has been cleaned.

US patent application 2009205832 A1 propose to replace the safety valve temporarily with a separation sleeve comprising a cross-port that connects the port where the control line enters the nipple. A feed line is connected to the cross port, and pressurized solvent can be applied to the feed line, or alternatingly between the control line and the feed line to remove the blockage.

A Similar approach is taken in US2009205831 A1 wherein a method for unblocking the control line comprises removing the safety valve from the nipple; setting into the nipple a sealing tool which sealingly connects the control line and a mini tubing running down into the production tubing; and increasing the pressure of a fluid into the mini tubing to cause fluid to flow into the control line through the sealing tool.

However, the replacement of the safety valve with the separation sleeve is time consuming and requires stop in the production.

US2009050333 A1 discloses a redundant control line where the two control lines are interconnected by a connecting valve. The connecting valve allows control fluid to communicate from the first control line to the safety valve but prevents fluid communication from the second control line to the first control line. To open the valve, the second control line is exhausted to a reservoir.

US20150158059 A1 discloses a similar flushing system, with a hydraulic downhole control line that runs from a hydraulic source to a surface controlled sub-surface safety valve. The hydraulic downhole control line having a directional control valve therein; and, a purge line that runs from the hydraulic downhole control line downstream of the directional control valve to a service line, where the purge line has a fluid isolation valve therein.

These system, with separate purge lines and additional valves, require a more complex installation process than single control lines. For established and completed well bores, such systems cannot be used without a work over of the well. Further, the last section of the control line, below the interconnection of the redundant control lines, is still a single feed line to the safety valve.

SHORT SUMMARY

A goal with the present invention is to overcome the problems of prior art, and to disclose a system and a method where production stops as a result of faulty control lines can be reduced.

The invention solving the above mentioned problems is a wellbore hydraulic line rectification device arranged to rectify a hydraulic line in-situ, the rectification device comprises;

a rectification line feeder, a longitudinal first rectification line, wherein the rectification line feeder is arranged to feed the first rectification line longitudinally into the hydraulic line, wherein a cross section of the first rectification line has at least three protrusions arranged to slide along an inner surface of the hydraulic line.

The invention is also a method for in-situ rectifying a wellbore SCSSV control line, where the method comprises the steps of;

feeding a longitudinal rectification line with a cross section with at least three protrusions longitudinally into the hydraulic line.

A major advantage of the current invention is that hydraulic lines can be maintained to prevent failures to e.g. the control system connected to the hydraulic line to happen, or repaired if failures have already happened without having to install additional equipment in a well work-over. This may prevent a time-consuming and costly shut-in. The result is reduced production losses and reduced capital spending.

An effect of the invention, is that the push force at the end of the rectification line is sufficiently large to remove obstacles and debris even when the hydraulic lines are hundreds of meter long and wound around the tubing.

EMBODIMENTS OF THE INVENTION

In the following description, various examples and embodiments of the invention are set forth in order to provide the skilled person with a more thorough understanding of the invention. The specific details described in the context of the various embodiments and with reference to the attached drawings are not intended to be construed as limitations. Rather, the scope of the invention is defined in the appended claims.

The examples provided are related to in-situ rectification of control lines for surface controlled sub-surface safety valves (SCSSV). However, the same rectification device, or an adapted rectification device, e.g. a rectification line with other dimensions due to the diameter of the hydraulic line in question, can be used for rectification of other types of hydraulic lines installed in the wellbore.

Figure 1:
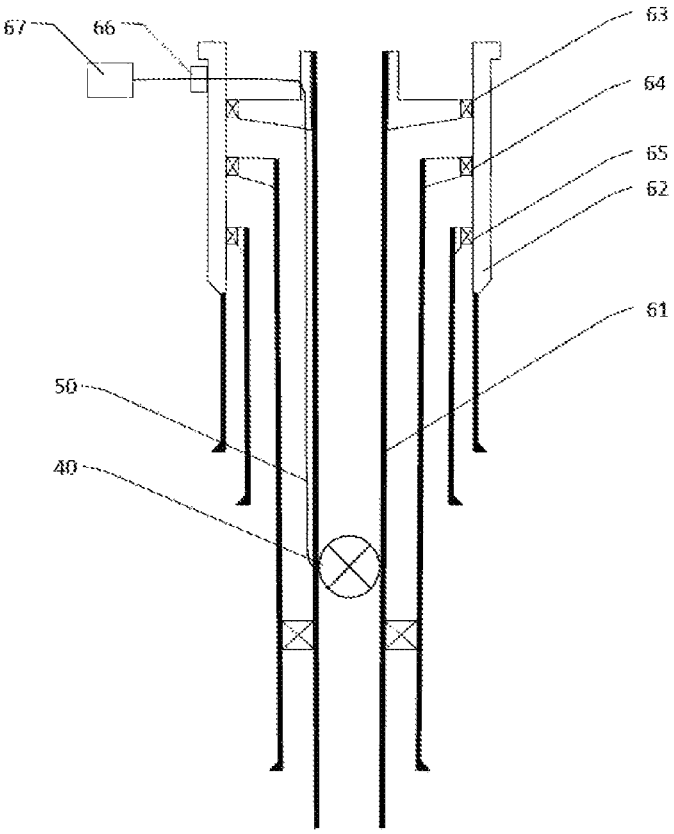
Fig 1 (prior art)
FIG. 1 shows a general, prior art description of a wellbore with a surface controlled sub-surface safety valve (SCSSV).
Figure 2A:
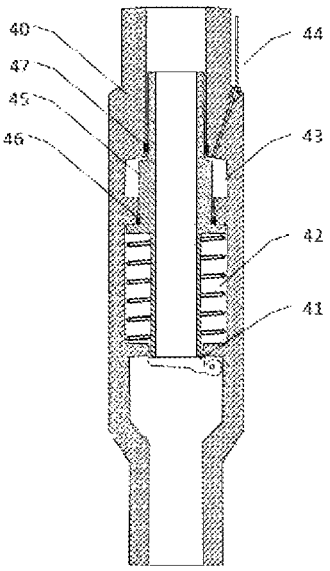
Fig 2a (prior art)
FIGS. 2*a* and 2*b* illustrates a surface controlled sub-surface safety valve (SCSSV) according to prior art.
Figure 2B:
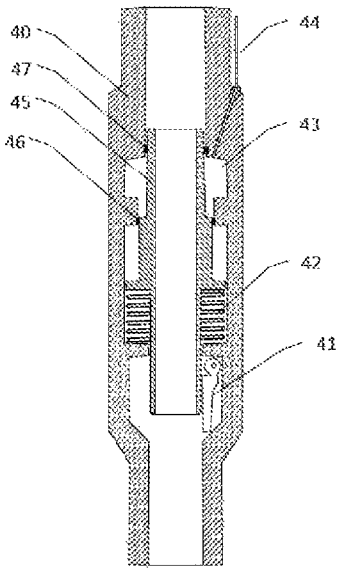
Fig 2b (prior art)

FIG. 1 illustrates a wellbore with surface controlled sub-surface safety valve (SCSSV) according to prior art as explained above, and FIG. 2 illustrates a SCSSV according to prior art.

When the control line used to operate the SCSSV becomes clogged or otherwise filled with debris over time, it is not possible to maintain pressure inside the control line all the way down to the safety valve, and the SCSSV will close. It is in this situation, or preferably before the control line is so clogged that the SCSSV closes automatically, that the current invention can be used to rectify or clean material and debris from the inside of the control line.

Figure 3:
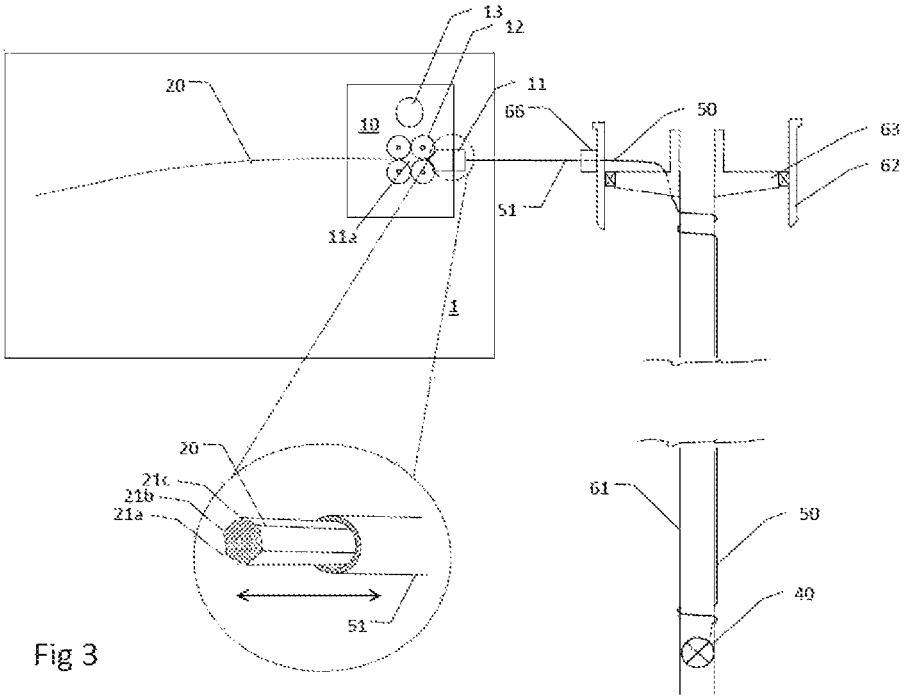
FIG. 3 shows a schematic view of an embodiment of the invention.

Referring now to FIG. 3 of the drawings, where a schematic illustration of an embodiment of the invention is shown, we see that the hydraulic control line (50) runs along the outside of the tubing (61), supported by the tubing hanger (63), between the SCSSV (40) and the wellhead (62). The SCSSV (40) and the control line (50) are part of the completion string in the wellbore.

In the event that it has been decided to rectify the control line (50), the control line rectification device (1) is connected to the control line (50), e.g. by disconnecting the control system (67) from the hydraulic block (66) located at the wellhead (62) outside the pressure barrier. An extension control line (51) may be used between the rectification device and the hydraulic block (66).

The rectification device (1) comprises a rectification line feeder (10) and a longitudinal first rectification line (20), wherein the rectification line feeder (10) is arranged to feed the first rectification line (20) longitudinally into the control line (50). The first rectification line (20) is in an embodiment sufficiently long to reach down to the SCSSV (40).

As seen in the dashed circle illustrating an enlargement of the section where the rectification line (20) enters the control line (50), the transverse cross section of the first rectification line (20) has protrusions (21*a*, 21*b*, 21*c* . . . ) that are arranged to slide along an inner surface of the control line (40). Although a cross section with six protrusions is shown for the first rectification line (20) in this Figure, other cross sections with three or more protrusions can be used to obtain the desired effect of the invention.

In an embodiment the cross section (CS) of the first rectification line (20) has 4, 5, 6, 7, 8 9, 10, 11 or 12 protrusions.

Figure 5:
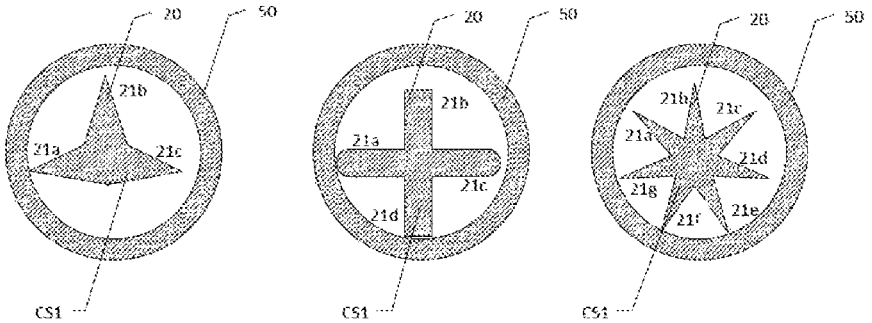
FIG. 5 illustrates some possible cross section embodiments of the longitudinal rectification line.

Exemplary embodiments of the cross section of the rectification line are shown in FIG. 5.

The illustrations show rectification lines (20) illustrated inside a control line (50). From the left, these rectification lines have a cross section with three, four and seven main protrusions (21*a*, 21*b*, 21*c*, 21*d*, 21*e*, 21*f*, 21*g*).

A protrusion is defined as a main protrusion only if it can reach the inner diameter of the control line (50), i.e. if it can slide along the inner surface. Thus, the left rectification line (20) of FIG. 5 has a minor protrusion in addition to the three main protrusions, but the minor protrusion cannot reach the inner diameter of the control line due to the geometry, and is therefore not considered a protrusion for the purpose of the invention.

A main protrusion may have zero or more edges. Zero indicates that it has a rounded outer surface. The middle rectification line of FIG. 5 has two edges on each of its vertical main protrusions, while the horizontal protrusions are curved. Preferably a rectification line has at least one protrusion with at least one edge.

The embodiments of rectification line cross sections should be seen as exemplary embodiments only. Other cross sections with other combinations of protrusions, and edges, solid or tubular, will fall within the scope of the invention, as defined by the claims.

When the protrusions have edges, the outer cross section (CS) of the rectification line (2) is in an embodiment a polygon, such as a star polygon illustrated to the right of FIG. 5.

In different embodiments the rectification line is made of steel, plastic material or a composite material.

FIG. 3 illustrates some more details of the rectification line feeder (10) that can be comprised in a further embodiment. It contains a termination block (11) arranged to terminate the extension control line (51) connected to the hydraulic block (66) on the wellhead in the opposite end.

It further comprises at least four feeding wheels (12) arranged in pairs, where the two wheels (12) of each pair is located on opposite sides of the rectification line (20), and arranged to move the rectification line (20) into the termination block (10*a*) and further into the extension control line (51) and the control line (50). The feeding wheels (12) are arranged to move and guide the rectification line (20) between the pairs of feeding wheels (12) by rotating and gripping the control line (20). The position of the feeding wheels (12) may be adjustable to accommodate different types of rectification lines (20) with different cross sections, and to adjust pressure against the rectification line to obtain the friction required for forcing the rectification line forward and into the hydraulic line (50). In an embodiment the feeding wheels (12) have a circular groove arranged to guide the rectification line (20), and further to improve the friction by interacting with a larger surface of the interaction line (20). Different sets of feeding wheels (12) with different circular grooves may be used for rectification lines (20) with different cross sections.

The feeding wheels (12) are driven by one or more feed motors (13). In an embodiment the one or more feed motors (13) are electrically powered. The feed motor may use any kind of transmission for driving the feeding wheels (12), such as belts, cog wheels, etc. as will be understood by a person skilled in the art.

In an embodiment the rotational speed of the feeding wheels (12) is synchronized. This can be a mechanical synchronization, e.g. by gears where the same motor is used to drive all wheels, or a synchronization controlled by a control loop in a control system if the wheels (12) are driven by individual motors.

The termination block (11) holds the extension control line (51) and will have to set up a counterforce similar in size to the force applied to the rectification line (20) by the rectification line feeder (10). It is therefore important that the termination block (11), and additional support blocks (11*a*) along the path of the rectification line (20), e.g. in between the feeding wheels (12) prevents lateral movement of any part of the rectification line (20) before it enters the extension control line (51).

The control line can be several hundred meters long and the rectification line (20) may be of approximately the same length. In an embodiment the control line rectification device therefore comprises a reel (30) for storing the rectification line (20). However, when the line is wound up on the reel (30) it is no longer straight. Since the rectification line has to be stiff to withstand radial deformation, it will also be difficult to enter into the narrow control line if it is bent. In this embodiment the rectification device (1) comprises a line straightener (15) arranged to straighten the rectification line (20) as it is fed into the control line (40) from the reel (30).

Figure 4:
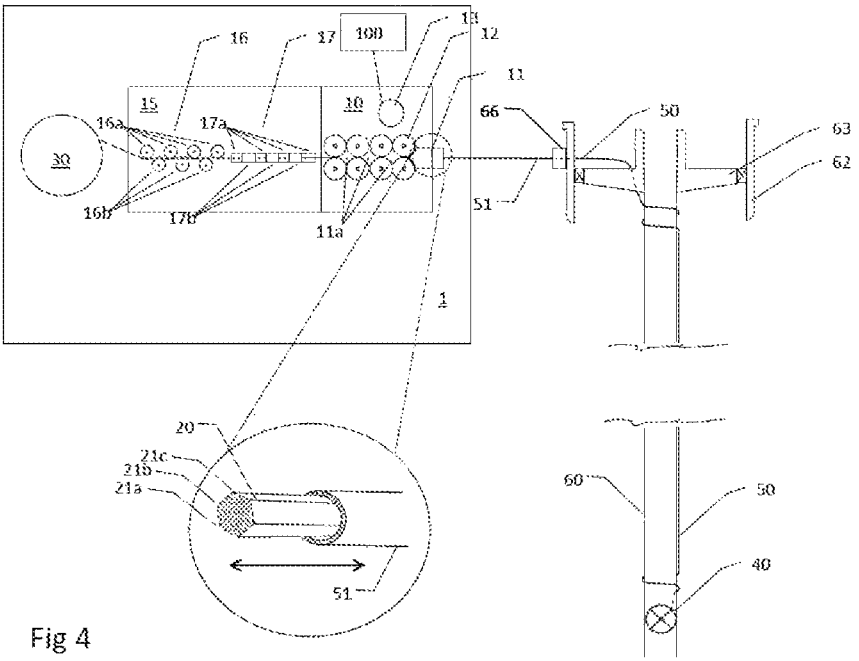
FIG. 4 shows a schematic view of an embodiment of the invention.

More details of the line straightener (15) is shown in FIG. 4. In an embodiment it comprises first and second straighteners (16, 17), arranged in series between the reel (30) and the line feeder (10), and arranged to straighten the rectification line (20) in perpendicular, lateral directions.

The first straightener (16) comprises a first set (16*a*) of two or more straightener wheels arranged in line, and a second set (16*b*) of two or more straightener wheels arranged in line, wherein the straightener wheels of the first and a second set (16*a*, 16*b*) are arranged to contact opposite sides of the rectification line (30), respectively.

In the same way the second straightener (17) comprises a third set (17*a*) of two or more straightener wheels arranged in line, and a fourth set (17*b*) of two or more straightener wheels arranged in line, wherein the straightener wheels of the third and fourth set (17*a*, 17*b*) are arranged to contact opposite sides of the rectification line (20), respectively.

The first and second straighteners (16, 17) are in an embodiment rotated 90 degree relative each other, so that the straightener applies forces to the rectification line from four different lateral directions, i.e. 0 and 180 degree from the first straightener and 90 and 270 degree from the second straightener.

In an embodiment it is one more straightener wheel in the first set or second set of straightener wheels (16*a*, 16*b*) than in the other set (16*a*, 16*b*) of the first straightener (16).

In an embodiment it is one more straightener wheel in the first set or second set of straightener wheels (17*a*, 17*b*) than in the other set (17*a*, 17*b*) of the second straightener (22).

In order to most efficiently rectify the control line (50), different rectification lines (20) with different cross sections may be run down the control line (50) sequentially.

E.g. a first run with one of the rectification lines (20) illustrated in the upper part of FIG. 5. The goal of the first run will be to apply as much force as possible on the end of the rectification line (20) to partly or completely open up the control line (50).

The control line should not be damaged or otherwise disabled by the rectification device and process. In an embodiment the rectification device (1) therefore comprises a control system (100) arranged to control a feed force of the rectification line feeder (10) when it is feeding the rectification line (20) into the control line (50).

The control system may use the power used by the motor as an indication of the push force and limit power to the motor when a threshold power is reached.

The invention is in an embodiment a method for in-situ rectifying a wellbore hydraulic line (50), wherein a longitudinal first rectification line (20) with a first cross section (CS1) with at least three protrusions is fed longitudinally into the hydraulic line (50).

A line feeder (10) as disclosed previously may be used.

In an embodiment the method comprises straightening the longitudinal rectification line (2) as it is fed into the control (2) line from the reel (30) by a line straightener (15) as disclosed previously.

In the exemplary embodiments, various features and details are shown in combination. The fact that several features are described with respect to a particular example should not be construed as implying that those features by necessity have to be included together in all embodiments of the invention. Conversely, features that are described with reference to different embodiments should not be construed as mutually exclusive. As those with skill in the art will readily understand, embodiments that incorporate any subset of features described herein and that are not expressly interdependent have been contemplated by the inventor and are part of the intended disclosure. However, explicit description of all such embodiments would not contribute to the understanding of the principles of the invention, and consequently some permutations of features have been omitted for the sake of simplicity or brevity.

The invention claimed is:

1. A wellbore hydraulic line rectification device arranged to rectify a hydraulic line extending into the wellbore, in-situ, comprising:

a rectification line feeder arranged above the surface; and a longitudinal first rectification line, wherein the rectification line feeder is arranged to provide a push force and feed the first rectification line longitudinally into the hydraulic line, and wherein a cross section of the first rectification line has at least three protrusions arranged to slide along an inner surface of the hydraulic line.

2. The wellbore hydraulic line rectification device of claim 1, wherein at least one of the three protrusions has at least one edge.

3. The wellbore hydraulic line rectification device of claim 2, wherein the first rectification line is made in metal or polymeric material.

4. The bore hydraulic line rectification device according to claim 2, wherein the cross section of the rectification line is a polygon.

5. The wellbore hydraulic line rectification device of claim 1, wherein the cross section of the first rectification line has 4, 5, or 6 protrusions.

6. The wellbore hydraulic line rectification device of claim 5, wherein the first rectification line is made in metal or polymeric material.

7. The wellbore hydraulic line rectification device according to claim 5, wherein the cross section of the rectification line is a polygon.

8. The wellbore hydraulic line rectification device of claim 1, wherein the first rectification line is made in metal or polymeric material.

9. The wellbore hydraulic line rectification device according to claim 8, wherein the cross section of the rectification line is a polygon.

10. The wellbore hydraulic line rectification device according to claim 1, wherein the cross section of the rectification line is a polygon.

11. The wellbore hydraulic line rectification device according to claim 1, wherein the rectification line feeder comprises at least four feeding wheels arranged in pairs, where the two wheels of each pair are arranged to be located on opposite sides of the rectification line.

12. The wellbore hydraulic line rectification device according to claim 1, comprising a reel for storing the first rectification line, wherein the rectification device is arranged to straighten the first rectification line as the first rectification line is fed into the hydraulic line from the reel.

13. The wellbore hydraulic line rectification device according to claim 12, comprising first and second straighteners, arranged in series between the reel and the line feeder, and arranged to straighten the rectification line in perpendicular, lateral directions.

14. The wellbore hydraulic line rectification device according to claim 13, wherein the first straightener comprises:

a first set of two or more straightener wheels arranged in line; and a second set of two or more straightener wheels arranged in line, wherein the straightener wheels of the first and second set are arranged to contact opposite sides of the rectification line, respectively.

15. The wellbore hydraulic line rectification device according to claim 14, wherein the second straightener comprises:

a third set or two or more straightener wheels arranged in line; and a fourth set of two or more straightener wheels arranged in line, wherein the straightener wheels of the third and fourth set are arranged to contact opposite sides of the rectification line, respectively.

16. The wellbore hydraulic line rectification device according to claim 14, wherein the first and second straighteners are rotated 90 degrees relative each other about the rectification line.

17. The wellbore hydraulic line rectification device according to claim 1, wherein the hydraulic line is a surface controlled safety valve control line connected to a surface controlled sub-surface safety valve in-situ.

18. A method for in-situ rectifying a wellbore hydraulic line extending into the wellbore, comprising the step of:

feeding a longitudinal first rectification line with a first cross section with at least three protrusions longitudinally into the hydraulic line with a rectification line feeder arranged above the surface and providing a push force.

19. The met of claim 18, wherein the longitudinal first rectification line is stored on a reel and the method comprises the step of straightening the longitudinal first rectification line as the longitudinal first rectification line is fed into the hydraulic line from the reel.

20. The method of claim 18, wherein the hydraulic line is a surface controlled safety valve control line connected to a surface controlled sub-surface safety valve in-situ.

* * * * *